United States Patent [19]
Antonious
[11] 4,275,513
[45] Jun. 30, 1981

[54] ADJUSTABLE AND FLEXIBLE CLOSURE ASSEMBLY FOR MONK STYLE SHOES

[76] Inventor: Anthony J. Antonious, 205 E. Joppa Rd., Towson, Md. 21204

[21] Appl. No.: 971,183

[22] Filed: Dec. 20, 1978

[51] Int. Cl.[3] ..... A43B 11/00
[52] U.S. Cl. ..... 36/50; 2/DIG. 6; 24/306
[58] Field of Search ..... 36/50, 51, 54, 128, 36/129; 2/DIG. 6; 24/204, 73 GC

[56] References Cited

U.S. PATENT DOCUMENTS

| | | | |
|---|---|---|---|
| 3,009,221 | 11/1961 | Firari | 36/50 X |
| 3,902,229 | 9/1975 | Doerpinghaus | 24/204 X |
| 4,079,527 | 3/1978 | Antonious | 36/51 |
| 4,126,951 | 11/1978 | Antonious | 36/54 |

FOREIGN PATENT DOCUMENTS

| | | | |
|---|---|---|---|
| 2271782 | 12/1975 | France | 24/204 |
| 2375841 | 7/1978 | France | 36/50 |
| 430494 | 8/1967 | Switzerland | 36/50 |

OTHER PUBLICATIONS

Velcro D-Rings, Velcro Corporation, Approx. Date 1962.
Proven Velcro Applications on Footwear, Velcro Corporation, Approx. Date 1962.
Technical Notes from the Artificial Limb Program, Reprinted from Artificial Limbs, vol. 6, No. 1, Apr. 1961, pp. 102–103.

*Primary Examiner*—James Kee Chi
*Attorney, Agent, or Firm*—Nicholas J. Aquilino

[57] ABSTRACT

Disclosed is a monk style shoe having an adjustable and flexible closure assembly utilizing separable fastening members having separable fastening members having coacting, flexible gripping elements, such as hook and loop Velcro type fastening means, including a fastener strap attached to one side of the shoe and one of the shoe quarters on the opposite side of the shoe elongated and having an opening through which the fastener strap passes. This improvement permits the wearer, using only one hand, to easily pull the shoe uppers simultaneously to the precise desired tautness and fasten the shoe.

16 Claims, 7 Drawing Figures

ADJUSTABLE AND FLEXIBLE CLOSURE ASSEMBLY FOR MONK STYLE SHOES

BACKGROUND OF THE INVENTION

This invention pertains to monk style shoes, particularly, dress shoes, golf shoes and other sports shoes, as well as other adapatable footwear.

Low-cut shoes presently made include types having a strap closure which utilizes a buckle to obtain tautness and to fasten the shoe on the wearer's foot. This type of closure has certain limitations in that the studs or latch of the buckle can be fastened only at predetermined holes in the strap thereby restricting the wearer from obtaining a precise custom-fit should only a minor variation in the position of the holes be required. Furthermore, strap closures using a buckle may be awkward for the user since both hands are required to hold the strap and to position the stud in the buckle in the desired strap holes each time the shoes are fastened.

In my prior U.S. Pat. No. 4,079,527 and No. 4,126,951 and co-pending application Ser. No. 890,487, I disclosed various closure assemblies for fastening shoes to maintain the desired tautness specifically across the instep. However, these closure assemblies rely on a D-ring or grommet attached on one side of the shoe, requireing the fastener strap, attached to the opposite side of the shoe, to extend across the instep to engage the D-ring or grommet and then to recross the instep to fasten the shoes with a hook and loop Velcro type fastening means. Further, the closure assemblies of U.S. Pat. No. 4,079,527 and 4,126,951 require attaching at least two straps to the shoe, one to form the anchor strap on one side of the shoe and another to form the fastener strap on the opposite side of the shoe.

The Shaw Pat. No. 3,845,769 is directed to a therapeutic boot "of essentially unyielding material shaped to fit a limb". The structure in Shaw relies on a plurality of bands with D-rings adjacent a split in the boot. The structure also requires the bands to cross and recross the split in the boot in order to fasten back upon themselves.

SUMMARY OF THE INVENTION

The present invention relates to monk style shoes having an adjustable flexible closure assembly designed to eliminate the problems created by conventional shoes utilizing buckles and other fastening devices as described above. The wearer is able to regulate the precise desired tautness by easily pulling the shoe uppers inwardly simultaneously and to fasten the shoe closure of the most comfortable position, using only one hand.

The closure assembly of the present invention utilizes a fastener strap having hook and loop Velcro type fastening means. The fastener strap is attached to the uppers on one side of the shoe. A section of the uppers on the opposite side of the shoe forms a quarter having a portion which is elongated forming an extension over the variable shoe opening. The elongated quarter extension includes an opening through which the free end of the fastener strap passes to secure the shoe. This construction permits a low profile appearance because of the single thickness of the elongated quarter resulting in a better looking shoe which is easier and more economical to produce and offers more versatlity of shoe design as well as provides a better fit with more comfort to the foot.

The adjustable and flexible closure assembly utilizes an opening in the form of a D-ring, grommet, plate or other achoring means in the elongated shoe quarter to engage the fastener strap. The improvement of the present invention requires only one strap to be attached to one side of the shoe, just the fastener strap which also includes the hook and loop fastening means. The quarter on the opposite side of the shoe, which is not a strap attached to the shoe but an integral part of the shoe, is elongated forming the extension and includes an opening through which the fastener strap is pulled to fasten the shoe. This construction allows the elongated quarter to extend over the instep only once to engage the fastener strap.

DESCRIPTION OF THE PREFERRED EMBODIMENTS

Figure 1:
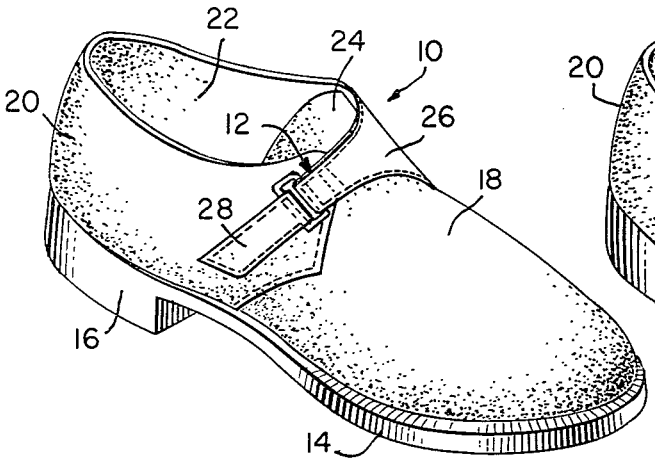
FIG. 1 illustrates one embodiment of the shoe of the present invention showing the closure assembly in the closed position.
Figure 2:
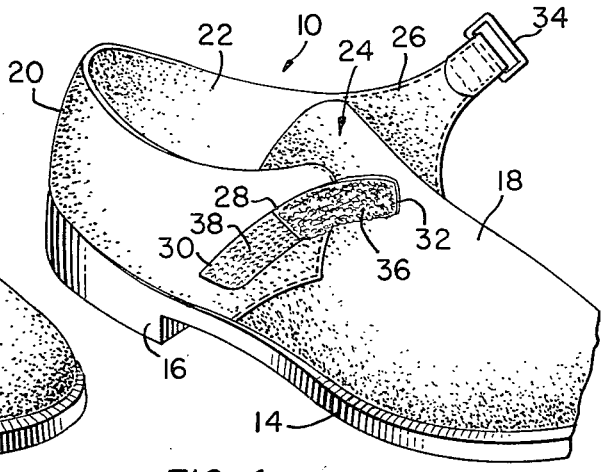
FIG. 2 illustrates the shoe of FIG. 1 with the closure assembly to the open position.

FIGS. 1 and 2 illustrates one embodiment of a low-cut shoe 10 having an adjustable closure assembly 12 used to secure the shoe on the foot of the wearer. The shoe is a conventional monk style dress shoe having a sole 14, heel 16 and shoe uppers including a vamp 18 and side quarters 20 and 22. The adjustable closure assembly 12 is adapted to extend over the shoe opening 24 formed between the quarter 20 on one side of the shoe 10 and the quarter 22 on the other side of the shoe. The flexible and adjustable closure assembly 12 utilizes a flexible, multi-adjustable, separable fastener having first and second fastening members including an array of complementary, coacting, flexible gripping elements on each of the members, for example, such as Velcro-type hook and loop separable fasteners. As best shown in FIG. 2, a portion of quarter 22 forms an elongated extension 26 which extends over the variable shoe opening 24 to engage a fastener strap 28 located on the opposite side of the shoe 10. The fastener strap 28 includes a fixed end 30 attached to the quarter 20 and a free end 32 adapted to cooperate with an opening in the form of a D-ring 34 on the free end of the elongated quarter extension 26. The fastener strap 28 includes a hook and loop type Velcro fastening means, formed of a pad of loop material 39 on the free end of the strap 28 and a pad of hook material 38 on the fixed end of the strap 28.

In order to secure the shoe, a wearer merely places the elongated quarter extension 26 over the shoe opening 24 and threads the free end 32 of the fastener strap 28 through the D-ring 34 and folds back the fastener strap 28 in order that the hook Velcro pad 38 will coact with the loop Velcro pad 36.

The degree of tautness may be regulated and is universally adjustable by controlling the amount that the fastener strap 28 is pulled through the D-ring 34 before the hook and loop fastener is secured. This arrangement provides a single span across the shoe opening 24 which may be easily fastened using only one hand. The arrangement further provides a universally adjustable closure assembly which permits a variety of instep sizes to be comfortably fitted while maintaining the necessary tautness to keep the show secured on the foot of the wearer.

Figure 3:
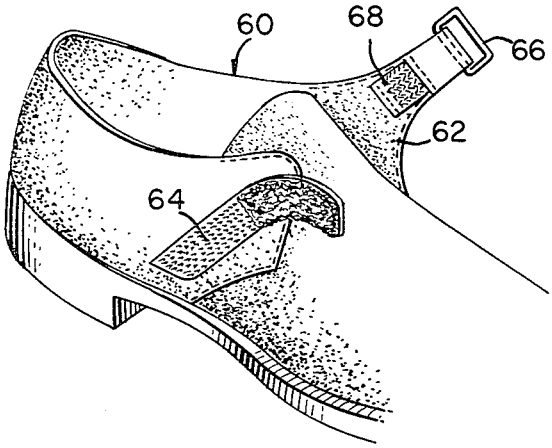
FIG. 3 illustrates a second embodiment of the shoe of the present invention.

FIG. 3 illustrates a second embodiment of the shoe 60 of the present invention. The shoe is the same general type as described with reference to FIGS. 1 and 2 and includes an elongated quarter extension 62 adapted to engage a fastener strap 64 in the same manner as described hereinabove. The end of the extension 62, which maintains a D-ring 66 in place, is provided with an elastic section 68 at the point where the end is secured back upon the extension 62 after securing the D-ring 66. This elastic section 68 provides flexibility at the end of the extension 62 after the fastener strap 64 is passed through the D-ring 66 and secured. The elastic section 68 allows for stretching, flexing or other foot movement to maintain a comfortable fit.

Figure 4:
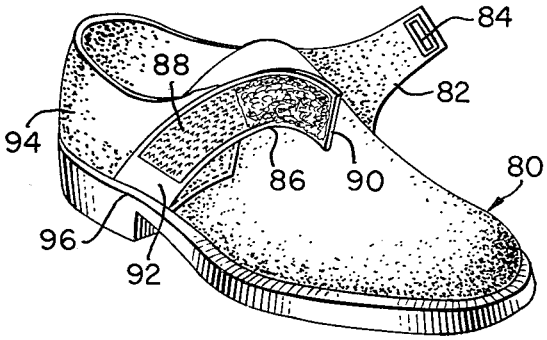
FIG. 4 illustrates a third embodiment of the shoe of the present invention.

FIG. 4 illustrates a third embodiment of the shoe 80 of the present invention which is also of the same general type as described with respect to FIGS. 1 and 2. An elongated quarter extension 82 includes an opening formed by a grommet 84 secured in the free end of the extension 82. A fastener strap 86 is also provided with a hook and loop type fastening means and is adapted to be secured after passing through the grommet 84 in the same manner as described hereinablve. The fastener strap 86 is formed of at least two layers of material one of which is the hook and loop Velcro fastening means 88 and the second of which is a trim member 90 covering the hook and loop fastener 88 when the closure assembly is properly secured. In addition, the fixed end 92 of the fastener strap 86 is secured to the shoe at a point where the shoe upper 94 and the sole 96 adjoin.

Figure 5:
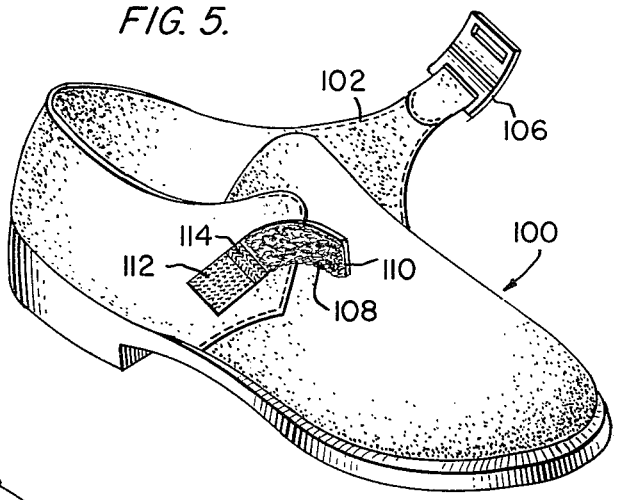
FIG. 5 illustrates a fourth embodiment of the shoe of the present invention.

FIG. 5 illustrates a fourth embodiment of the shoe 100 of the present invention which also is the same type as described with respect to FIGS. 1 and 2. The shoe includes an elongated quarter extension 102 having an opening provided by a connector plate 106 which is permanently secured to the free end of the extension 102. A fastener strap 108 includes a hook and loop Velcro type fastening means formed of a pad 110 of loop type Velcro material on the free end of the strap 108 and a pad 112 of loop type Velcro material on the fixed end of the strap 108. The fastener strap 108 is provided with an elastic section 114 located between the loop Velcro pad 110 and the hook Velcro pad 112. The elastic section 114 permits natural flexing of the strap 108 in order to provide additional comfort to the wearers foot.

Figure 6:
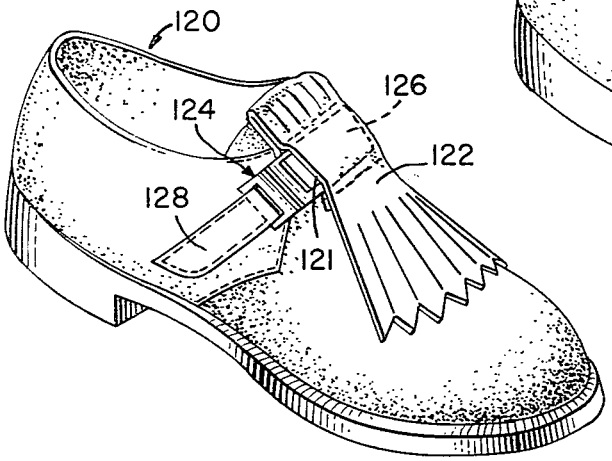
FIG. 6 illustrates a fifth embodiment of the shoe of the present invention.

FIG. 6 shows a fifth embodiment of the shoe 120 of the present invention which is a golf shoe provided with a shawl 122 positioned over the adjustable closure assembly 124.

The adjustable closure assembly 124 is the same type as described with respect to FIGS. 1 and 2 and includes an elongated quarter extension 126 which passes through shawl loop 121 and a fastener strap 128. The structure of this shoe secures the shawl 122 in place and holds it there once the adjustable closure assembly 124 is secured.

Figure 7:
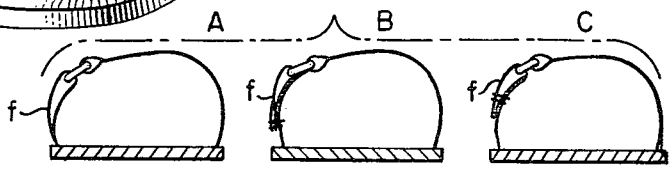
FIG. 7 shows three sectional view of various arrangements of the adjustable closure assembly of the present invention.

FIG. 7 shows three alternate placements on the shoe uppers for the fastener straps in section. FIG. 7*a* shows a fastener strap f secured into the joint where the show uppers and the sole are joined. FIG. 7*b* shows the fixed end of the fastener strap f secured adjacent the sole. FIG. 7*c* shows the fixed end of the fastener strap f secured in an upper position on the shoe.

It will be appreciated that many modifications and variations may be made to the above invention. As indicated above, any suitable separable fastener including first and second fastening members having complementary, coacting, flexible gripping elements may be used in place of the hook and loop fastening means specifically described in the specification. Other changes may be made, for example, any of the specific closure assemblies are interchangeable in all embodiments and may be used therewith. For example, the various openings shown are interchangeable including D-rings, grommets, plates and so forth. Also, elasticized Velcro fasteners and straps having elastic sections may be used in any of the embodiments. Other variations of this invention will be obvious in view of the following claims.

What is claimed is:

1. A monk style shoe having a sole and uppers, said uppers including an undivided vamp and quarters with a variable opening formed between said quarters and the upper portion of said undivided vamp, the improvement including an adjustable and flexible closure assembly comprising a flexible, multi-adjustable, separable fastener means having first and second fastening members including arrays of complementary, coacting flexible gripping elements for securing said closure assembly; a fastener strap included on one side of said shoe having a fixed portion and a free end, said free end including said first fastening member, said second fastening positioned adjacent said fixed portion of said fastener strap; and one of said quarters opposite said fastener strap having an integral, elongated extension with an opening for receiving said fastener strap through which the free end of said fastener strap passes permitting the uppers of said shoe to be pulled inwardly simultaneously perrmitting adjustment to the precise desired tautness of said closure assembly to fasten said shoe.

2. The shoe of claim 1 wherein said elongated extension includes a free end extending over said variable shoe opening.

3. The shoe of claim 1 wherein said opening in said elongated extension is formed by a D-ring attached to the free end of said elongated quarter.

4. The shoe of claim 1 wherein said opening in said elongated extension is formed of a grommet in the free end of said elongated quarter.

5. The shoe of claim 1 wherein said opening in said elongated extension is formed of a connector plate attached to the free end of said elongated quarter.

6. The shoe of claim 2 wherein said free end of said elongated extension includes an elastic member.

7. The shoe of claim 1 wherein said fastener strap includes an elastic member.

8. The shoe of claim 1 wherein said fixed end of said fastener strap is secured to the shoe at a point where said uppers and said sole are joined.

9. The shoe of claim 1 wherein said fixed end of said fastener strap is secured on said shoe upper adjacent said sole.

10. The shoe of claim 1 wherein said fixed end of said fastener strap is secured in an upper portion of said shoe.

11. The shoe of claim 1 further includes a shawl positioned and secured by said adjustable closure assembly.

12. The shoe of claim 1 wherein said fastening means is formed of a pad of hook Velcro type material and a pad of loop Velcro type material.

13. The shoe of claim 12 wherein one of said hook and loop Velcro type pads is located adjacent the free end of said fastener strap.

14. The shoe of claim 12 wherein one of said hook and loop Velcro type fastener pads is located adjacent the fixed end of said fastener strap.

15. The shoe of claim 1 wherein said fastener strap is formed of at least two layers including a first layer of hook and loop Velcro type fastener pads and a second layer of trim material, said trim material being adapted to cover said hook and loop Velcro type fastener pads.

16. The shoe of claim 1 wherein said arrays of complementary, coacting flexible gripping elements include an array of hook type gripping elements on said first fastening member, and an array of loop type gripping elements on said second fastening member.

* * * * *